United States Patent [19]

Bowman

[11] Patent Number: 4,969,770

[45] Date of Patent: Nov. 13, 1990

[54] MANHOLE COVER SUPPORT WITH TOPSIDE FLANGE

[76] Inventor: Harold M. Bowman, 18867 N. Valley Dr., Fairview Park, Ohio 44126

[21] Appl. No.: 362,277

[22] Filed: Jun. 6, 1989

Related U.S. Application Data

[63] Continuation-in-part of Ser. No. 76,668, Jul. 23, 1987, Pat. No. 4,834,574, and Ser. No. 201,573, Jun. 1, 1988, Pat. No. 4,867,600, and Ser. No. 323,622, Mar. 14, 1989, abandoned, and Ser. No. 207,185, Jun. 15, 1988, Pat. No. 4,872,780, and Ser. No. 207,266, Jun. 15, 1988, Pat. No. 4,867,601, and Ser. No. 207,326, Jun. 15, 1988, abandoned, and Ser. No. 207,325, Jun. 15, 1988, abandoned.

[51] Int. Cl.[5] ..... E02D 29/14

[52] U.S. Cl. ..... 404/26; 52/20

[58] Field of Search ..... 404/25, 26; 52/19–21; 49/41, 466

[56] References Cited

U.S. PATENT DOCUMENTS

| | | | |
|---|---|---|---|
| 3,326,100 | 6/1967 | White | 404/26 |
| 3,773,428 | 11/1973 | Bowman | 404/26 |
| 3,926,533 | 12/1975 | Binette | 404/26 |
| 4,029,425 | 6/1977 | Pelsue | 404/25 |
| 4,121,390 | 10/1978 | Hall et al. | 404/26 X |
| 4,188,151 | 2/1980 | Hall | 404/26 |
| 4,828,274 | 5/1989 | Stannard | 404/25 X |

OTHER PUBLICATIONS

One page from Spec. No. 715-13, N.Y. State Dept. of Transportation, Albany, N.Y. entitled "715-13 Prefabricated Adjustment Rings and Frames for Drainage Units and Manholes"—published prior to 1983.

*Primary Examiner*—Ramon S. Britts
*Assistant Examiner*—Matthew Smith
*Attorney, Agent, or Firm*—Watts, Hoffman, Fisher & Heinke Co.

[57] ABSTRACT

A manhole cover support is shown. It is used for raising the effective grade of an existing manhole cover-receiving structure having an upwardly projecting keeper with a rim at its top. The cover support comprises: a peripheral flange that at least substantially completely covers the rim, the thickness of the flange providing the raise in the grade, the flange including a bottom for resting on the rim, a seat for a manhole cover, and a cover keeper that rises from the outer periphery of the seat; and the flange anchored to a fixed part of the existing manhole structure.

27 Claims, 6 Drawing Sheets

MANHOLE COVER SUPPORT WITH TOPSIDE FLANGE

REFERENCE TO OTHER APPLICATIONS

This patent application is a continuation-in-part of applicant's U.S. patent applications: Ser. No. 07/076,668, filed on Jul. 23, 1987, entitled *Utility Cover Extension* U. S. Pat. No. 4,834,574; Ser. No. 07/201,573 filed on Jun. 1, 1988, entitled *Polygonal Manhole Cover Support* U.S. Pat. No. 4,867,600; Ser. No. 07/323,622, filed on Mar. 14, 1989, entitled *Support For A Manhole Cover of Standardized Diameter* abandoned; the following filed on Jun. 15, 1988, specifically Ser. No. 07/207,185 entitled *Manhole Cover Support With Box Flanging* U.S. Pat. No. 4,872,780; Ser. No. 07/207,266 entitled, *Sturdy Adjustable Manhole Cover Support* U.S. Pat. No. 4,867,601; Ser. No. 207,326 entitled *Manhole Cover Support Having Enhanced Grip* abandoned; and Ser. No. 207,325 entitled *Manhole Cover Support Resistant To Water Infiltration* abandoned; and the following applications filed on even date herewith, entitled *Multicomponent Wales and Bases for Manhole Cover Supports* Ser. No. 362,257, pending; and *Manhole Cover Support With Interbraced Top Members* Ser. No. 362,216, pending. The teachings of those applications are incorporated herein by reference.

BACKGROUND OF THE INVENTION

This invention relates to manhole cover supports for emplacing over and raising the effective grade of an existing manhole cover-receiving structure, and more particularly to such supports that are to be resistant to water infiltration around them and/or are for accommodating a group of manhole covers of a standard size and shape where the frames thereunder diverge somewhat as to the size of the otherwise geometrically similar covers that they can take.

For simplicity the term "existing manhole cover-receiving structure" is used here to refer to the existing, i.e., fixed in-place frame or other seating receptacle for a removable cover or grating that covers an access hole (i.e., hand hole, tool hole, manhole, catch basin or the like). The term "manhole cover" is used to refer to the removable cover or grating over the access hole. The resulting assembly of a receiving structure and a manhole cover ordinarily is intended to bear vehicular traffic. The term "manhole cover support" or simply "cover support" here means a structure that fits over the existing manhole cover receiving structure, raises its grade, and thereby accommodates a cover or grating at the new elevated grade. The access hole covered is a utility enclosure serving, e.g., an electric, gas, water, sewer or storm drainage system.

The preponderance of manholes are circular (in street plan), have circular covers and have existing cover-receiving structures such as frames that are circular with circular cover keepers (also sometimes called "collars"). Accordingly, much of this specification is directed to round manhole cover supports that have ring-like annular elements which are to interact with an existing round manhole cover-receiving structure. However, it should be understood that this invention can be utilized in connection with other shapes of cover support, eg. rectangular, square, triangular, hexagonal and so on, and further that the instant cover support which is to be fitted to the usual circular hole of a frame can be adapted to take a round cover or one other than round, e.g. hexagonal, and still further this cover support need not have an outer periphery at pavement level that is round—that periphery can be, for example, square or octagonal.

Ordinarily a cover support finds its use when a roadway such as a street or highway is resurfaced with an added layer of paving material, typically asphalt concrete or sheet asphalt, to establish a higher grade. A principal use for the instant cover support is expected to be in a municipality where a group of manhole installations of somewhat varying diameters are likely to be encountered in the resurfacing. Thus, adjoining or the same subdivisions, boroughs, wards or districts may have existing manhole cover frames for accommodating a group of covers that are nominally of several fairly close sizes, say 22½ to 24 inches in diameter. When resurfacing in such an area, it may be decided to standardize on a single size 23-, 24- or 25-inch diameter cover for this group to reduce the inventory of covers, purchase them in larger lots, avoid potentially costly custom-built equipment or short manufacturing runs, and certainly to eliminate the digging out, raising and resetting of the existing frames or other cover-receiving structures simply to accommodate their original variously-sized manhole covers. It then can be especially advantageous to mount the inventive cover supports atop these existing manhole cover frames for the standardization purpose.

Heretofore the typical installation of new manhole cover supports has seemingly been circumscribed by and restricted to the reuse of the old cover. The possible benefits of standardizing on a new cover size (and possibly shape) in place of a group of geometrically similar covers that vary a little in size from one to another or from one subgroup to another, then designing a new cover support expressly for the new standardized covers appears to have gone unrecognized; it does not seem to have been addressed at all by the art.

Apart from the economies available from and the simplicity of such standardization practice, the instant cover support also has another great advantage over conventional manhole cover supports, whether adjustable in periphery or not, in that its basic design renders its usual installation on a manhole cover frame inherently quite resistant to the infiltration of surface water from around its outer walls. Part of this is because its peripheral flange part (i.e. the fixed diameter top ring in the case of the usual annular cover support), usually has no gaps and generally is quite flat whether the peripheral flange is made in one unitary piece or is assembled from a plurality of abutting parts, e.g. with bolts.

The lack of such gaps in some prior unexpandable manhole cover supports is itself a conventional feature. However, the bottom of the peripheral flange of the instant cover support is borne, quite unconventionally, upon the top surface (rim) of the cover keeper of the existing manhole cover-receiving structure, e.g. a manhole cover frame, and that top surface (rim) ordinarily also is without gaps. The continuous, uninterrupted surfaces of the flange bottom and the receiving structure top rim in substantially horizontal contact with each other usually makes for a good blockage of surface water infiltration into the installation from around the outside of the new cover support. This cannot be achieved consistently using a conventional unexpandable cover support that is supported at least mainly if not entirely by the cover seat (and possibly some rising inside surfaces thereabouts) of the existing cover-receiving structure, e.g. the frame. Unless such unexpandable conventional cover support luckily just happens to fit the seat region of such receiving structure like a cork in a bottle, water leakage around a substantially looser fit is quite likely. Furthermore, because normal dimensional tolerances for castings such as cast iron manhole cover frames can be as much as $\pm\frac{1}{8}$ inch per foot, it is rare that a truly leak-resisting fit will result between such cover support and such frame. In contrast, the peripheral flange of the new support resting on the rim of the frame of the inventive cover support generally effects water blockage without having to make a snug fit into any recess, but rather simply by being disposed on the rim that surrounds it.

The resistance of the instant cover support to surface water infiltration around the outer periphery of the instant support can be improved when a deformable water seal is interposed between the top of the keeper of the receiving structure (the rim) and the bottom of said peripheral flange.

Prior art on manhole cover supports and manhole cover frames can be found in U.S. Pat. Nos. 4,281,944, 4,236,358, 4,203,686, 3,968,600, 3,773,428, 4,225,266, 4,302,129, 4,097,171, 4,302,126, 3,891,337 and 1,987,502. The first five of these are for inventions of the applicant.

Axle loads up to 18,182 kg. must be resisted by many of these cover supports as well as serious impact loads from vehicles and snow plows, a variety of temperature effects, steam leaks, spillage, etc., without permitting a hazardous dislocation of the cover support or its cover. Often it is desirable also to cushion the cover for resisting wear or reducing noise, and/or to seal the cover and its cover support against a substantial and possibly overloading infiltration of surface water, e.g., storm drainage that otherwise would enter a sanitary sewer system at various manhole locations.

The instant cover support can be made especially highly resistant to displacement and dislodgement in service. Thus, while it preferably incorporates structural or mechanical holddown (anchoring) means to the existing manhole cover-receiving structure, such hook-like extensions that are integral with it or easily attached, it also can be constructed to do a good job of holding in (being retained in the existing manhole cover-receiving structure, such as a frame, while in service) by friction alone.

Also, the support lends itself readily and simply to being sealed off against water infiltration and to cushioning the cover. Its unique structure fills a place in street maintenance that has heretofore been neglected.

BROAD STATEMENT OF THE INVENTION

In its broadest sense the instant manhole cover support is for raising the effective grade of an existing manhole cover-receiving structure that has a keeper with an upper rim. It comprises:

a peripheral flange that at least substantially completely covers the upper rim of the keeper of the existing manhole cover receiving structure to which it is to be fitted, the flange including a bottom for resting on said rim, a seat for the manhole cover, and a cover keeper that rises from the outer periphery of the seat; and means for anchoring the flange to a fixed part of the existing manhole structure.

When the instant cover support is used for the manhole cover size standardizing purpose essentially as described hereinbefore, the outer periphery of the flange must be at least practically coextensive with the outer periphery of the largest of the existing manhole cover-receiving structures of a group whose grade is to be raised by the same size of support. Such peripheral flange needs a good bearing surface from the rim of any of such receiving structures of the group. The outer periphery of the cover support, of course, can extend even further outward any case, and this usually is desirable, as a built-in factor of safety. The vertical distance between the bottom and the seat of the peripheral flange is the addition to grade provided by the cover support. Confining the cover laterally in the cover support is a keeper. It rises from the outer periphery of the seat of the cover support. The keeper can constitute the outer limits of the peripheral flange for a larger manhole cover, or it can rise inboard of the outer edges of the flange for confining a somewhat smaller manhole cover. Thickness of the keeper wall also can help to determine the cover size. As indicated earlier, the shape of a new cover support is independent of the original cover shape; it need not be of the same shape or size as the original.

The means for anchoring the peripheral flange to a fixed part of the existing manhole structure can include one or more of the following general types. One type is directly gripping; it includes a plurality of downwardly-reaching extensions that grip, i.e. which can be hooked or otherwise fastened directly to or under, the sill of the existing cover-receiving structure or other fixed part of the manhole structure below that. Another type is staged gripping; it includes a base that is held securely within the confines of the keeper of the existing manhole cover receiving structure and the peripheral flange is secured to that base. A preferred device for staged gripping includes an expandable base having at least one adjustable joint equipped with a spreader device capable of making the base fit tightly within the confines of the lateral keeper of the existing manhole cover receiving structure, said base being engaged with the peripheral flange for precluding substantial vertical separation of flange from base. A preferred cover support includes staged gripping of this sort in addition to plural direct extensions of the base that hook or otherwise fasten to the sill of the manhole cover receiving structure or other fixed part of the manhole structure below that level. These can be similar to the extensions described above for the flange. The existing manhole structure includes the existing manhole cover-receiving structure such as the manhole cover frame and the manhole structure therebelow such as the sidewalls or bottom.

BEST MODES FOR CARRYING OUT THE INVENTION

Figure 1:
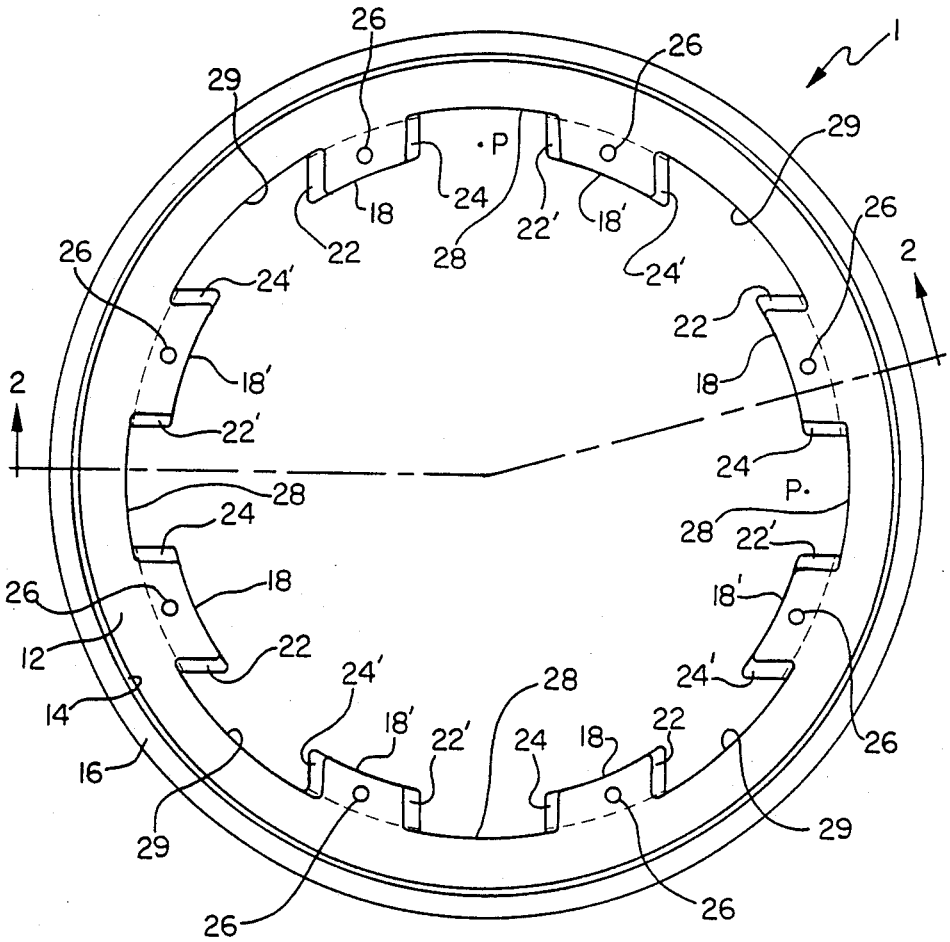
FIG. 1 is a top plan view of the cast iron peripheral flange (ie., the top ring) of a preferred embodiment.

Reference is made to FIGS. 1 to 9. The arrows 1 of FIGS. 1 and 2 indicate generally the peripheral flange (top ring) for a nominally 25-inch diameter manhole cover. The flange, with its annular, essentially flat cover seat 12 and flat bottom directly below the seat 12, the inner wall of the annular keeper 14, and keeper top 16, is made of cast ductile iron (ASTM type 536, Grade 60-45-12). The inner, almost vertical wall of the keeper 14 is 1.4 inches tall. It rises with about a 6° flair outward from the vertical. The thickness of the metal directly below the seat provides the rise in grade (added manhole cover elevation); that usually will be between about ¾ inch and about 2 inches. The flange can, of course, be waffled or ridged below the seat and/or on it, or otherwise partially hollowed out to lessen the weight.

Bracketing 9 o'clock in the flange are a pair of lugs 18 and 18'. There are four pairs of these lugs spaced evenly around the flange 1. As each pair is of generally identical construction, like reference numerals refer to like construction elements herein. This also is the case with the base (base ring) segments, a single one of which is indicated generally by arrow 2 in FIG. 3, and, further, those base segments which are shown to be interconnected with turnbuckle bolts 61 in FIGS. 5, 8, and 9. This also is the case with the turnbuckle bolts 61 themselves, these being shown in FIGS. 5, 7, 8, and 9, and the holddown (anchoring) clamps 36 of FIGS. 3, 5, 7, 8, and 9.

The tops of lugs 18 and 18' are flush with seat 12. The sides of a lug project almost vertically downward for the thickness of the seat 12, then flare or dovetail out below that for sliding into and engaging with a slot in the base ring. The outwardly and downwardly slanting sides 22 and 24 of the lug 18 and the corresponding sides 22' and 24' of lug 18' bound the dovetail parts of each lug pair. The pair of lugs bracketing 9 o'clock are parallel to each other and are directly opposite to the pair bracketing 3 o'clock; and the pair at 6 o'clock parallel to each other and are directly opposite the pair bracketing 12 o'clock.

Figure 2:
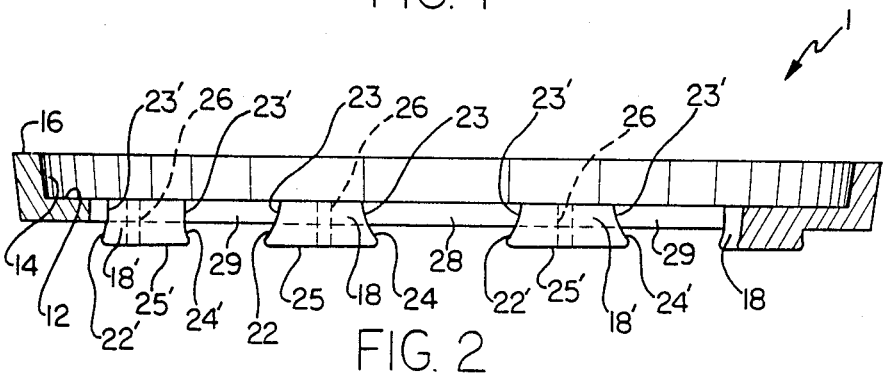
FIG. 2 is a cross sectional elevation of the peripheral flange of FIG. 1 taken through the lines 2—2.
Figure 3:
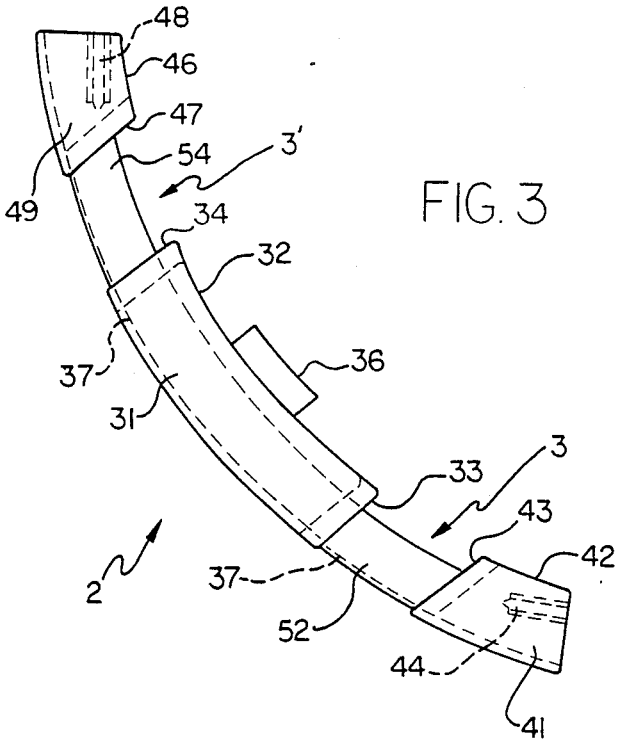
FIG. 3 is a plan view of one segment of the base (i.e., the base ring) of the same embodiment.

In a preferred form, each dove-tailed portion of a lug 18 and 18' has generally vertical parallel side surfaces, as at 23 and 23' of FIG. 2. These side surfaces merge into the lower slanted side surfaces or shoulders 22 and 24 on lug 14, and into shoulders 22' and 24' on a lug 14' to define a generally trapezoidal configuration in cross-section, as seen in FIG. 2. The side surfaces 23 and 23' extend downward nearly parallel to one another with respect to each pair of lugs. For example, in the embodiment illustrated in FIG. 1, there is illustrated the four pairs of lugs 18 and 18' such that the side surfaces 23 and 23' of each adjacent pair extend substantially parallel to one another; the mid-point of the space between lug pairs, as at P between adjacent lugs in each pair, is disposed on the vertical and horizontal axis of the top ring 1. The slanted side surfaces or shoulders of lug 18, items 22 and 24, extend downwardly and outwardly (FIG. 2) and merge into a generally flat bottom surface, as at 25, which surface lies in a common horizontal plane below and generally parallel to the top and bottom surfaces of the seat 11. The vertical height of the dove-tailed portions 23 is generally the same as corresponding vertical thickness of the seat 11. The four central spaces between pairs of lugs 18 and 18' are almost rectangular in horizontal cross section; each is bounded at the rear by the run 28 of the arcuate inner wall of the seat 12 and the vertical portions 23 and 23' of the lug walls directly facing each other. The four spaces intermediate to pairs of lugs 18 and 18' are almost trapezoidal in horizontal cross section. Each is bounded at the rear by a longer run 29 of the arcuate inner wall of seat 12 and the vertical portions 23 and 23' of the lug walls.

In the invention, while four pair of lugs (eight lugs in all) have been illustrated, it will be understood that the invention could be practiced with two pair of oppositely disposed lugs, although a greater number of symmetrically disposed lugs are preferred so as to achieve a greater uniformity in the peripheral adjustment of the segmented base ring 4 of FIG. 5, as will hereinafter be more fully described.

Centrally in the top of each lug is a tapped vertical hole 26 for set screws (not shown) that in use will not project above the seat 12. The set screws will act as separating lifts to jam the assembled peripheral flange and base slightly apart, thus enabling the cover support to better resist vibration. Wedges also could be used for this. FIG. 2 shows cover seat 12, inner wall of the keeper 14, keeper top 16, and lugs 18, and 18'.

Figure 5:
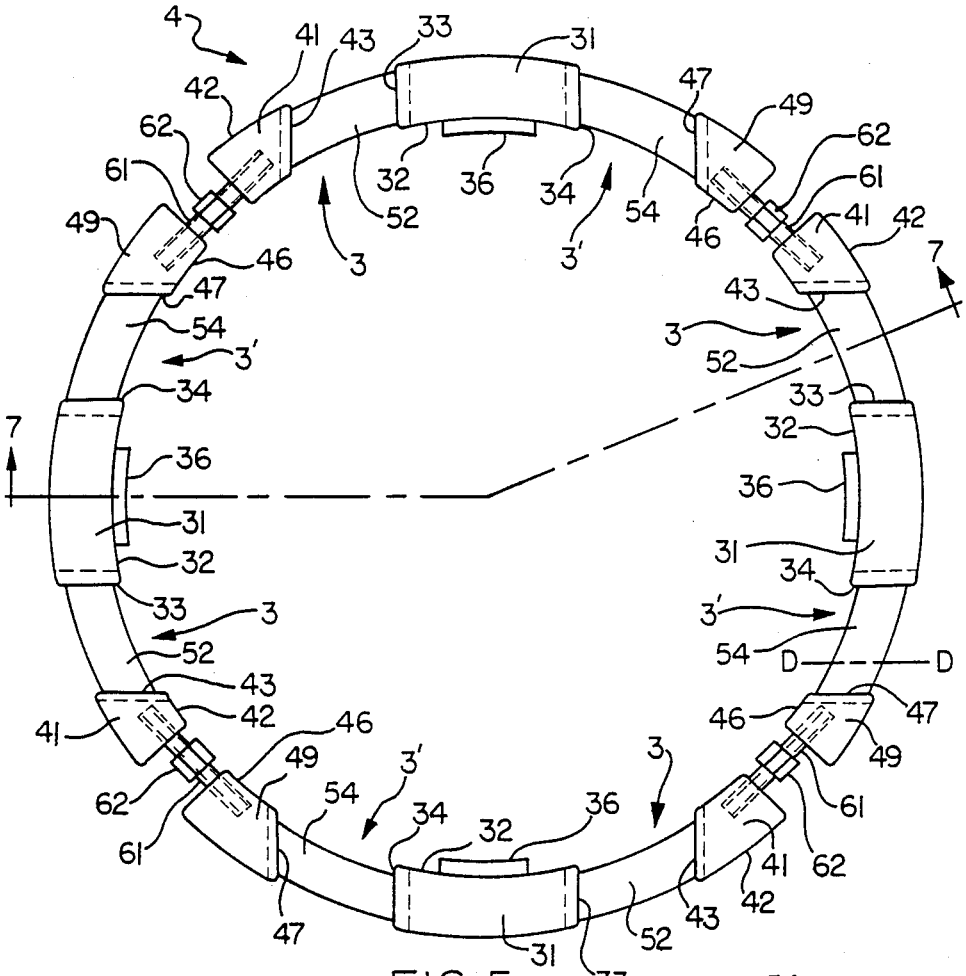
FIG. 5 is a top plan view of the cast iron base of the same embodiment.
Figure 8:
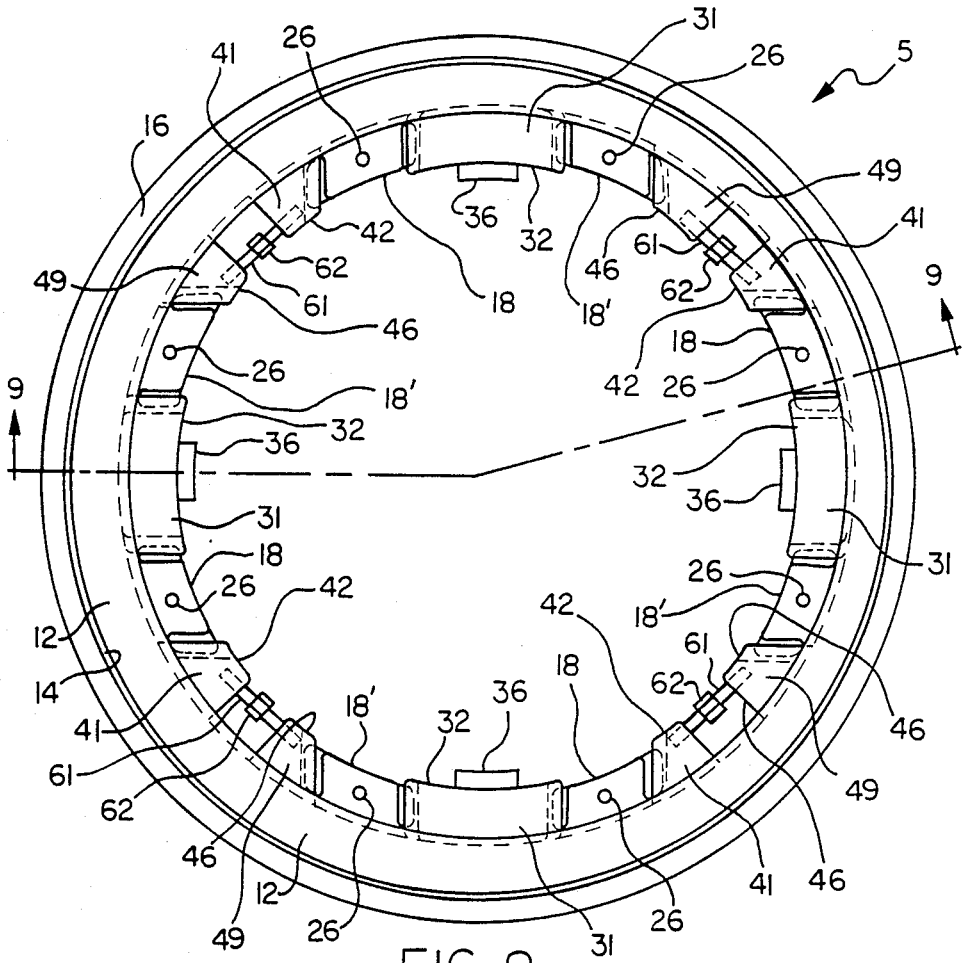
FIG. 8 is a plan view of the peripheral flange and the base of the same embodiment assembled wherein the lugs of the flange are engaged with the slots of the base. For simplicity the polymeric sealer and frictional retention component bonded to parts of the structure are not shown in this FIG. 8, but are incorporated in FIG. 9 that follows.

The base (i.e. the base ring) of this cover support is made in four like segments joined by turnbuckle bolts 61 as shown in FIGS. 5 and 8. Arrow 2 of FIG. 3 refers generally to one such segment. Segment ends 42 and 48 and segment center lobe 32 have flat tops 41, 49, and 31, respectively, all of which are in the same essentially horizontal plane. These segment ends and center lobe rise from and are integral with a lower flat support member 52; they overhang member 52 on the inside, as shown in FIG. 5. The sloping wall 43 of end 42, the sloping wall 33 of lobe 32, and the generally horizontal bottom surface 52 of a slot (generally indicated by arrow 3') bound the slot 3'; the sloping wall 34 of lobe 32, the sloping wall 47 of end 46, and the essentially horizontal bottom surface 54 of the companion parallel slot of the pair (generally indicated by arrow 3) bound the slot 3. A vertical cross section of slots 3 and 3' is generally trapezoidal with the base down; both slots of the pair are of essentially the same conformation. Slot 3 is sized to accept the dovetailed slanting sides 22 and 24 of the lug 18 shown in FIG. 1; the bottom 28 of the lug 18 is slidable (within the limits of a manhole cover frame having an effective diameter that accommodates nominally a 22½–24 inch diameter cover) across the bottom surface 52 of slot 3 in response to adjustment of the outer periphery of the base ring by means of enlarging or diminishing reasonably evenly the four gaps between opposing segment ends 42 and 48 using the turnbuckle bolts 61, shown in FIG. 5. Segment ends 42 and 46 (FIG. 3) have tapped screw holes 44 and 48 to receive the threaded ends of the turnbuckle bolts 61. A holddown grip 36 is welded to the inside of lobe 32 and projects below the bottom of this base ring to anchor it to the existing receiving structure, a manhole cover frame not shown.

Figure 4:
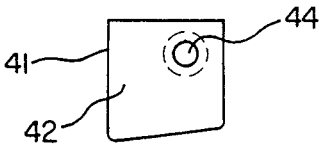
FIG. 4 is an end view of the lower end of the segment shown in FIG. 3.

In FIG. 4 the terminus of segment end 42 is shown with its top surface 41 to the left and the top of the tapped hole 44 facing the viewer.

Figure 7:
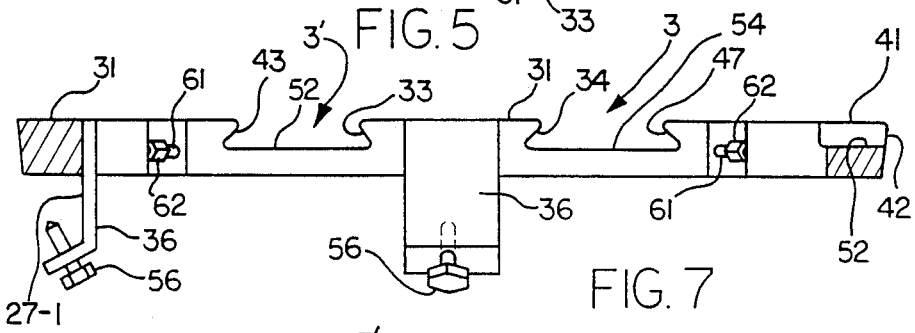
FIG. 7 is a cross sectional elevation of the base of FIG. 3 taken through the lines 7—7.
Figure 6:
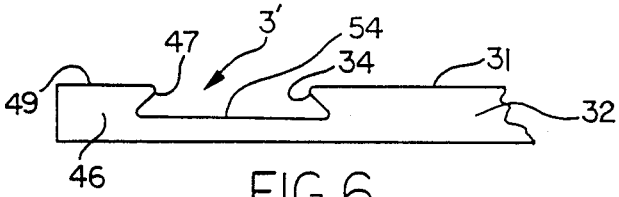
FIG. 6 is a fragmentary side elevation of the base of FIG. 3.

The arrow 4 of FIG. 5 generally indicates the four segments of the base ring joined together with turnbuckle bolts 61 having wrench grips 62. The dovetail shape of slot 3' is seen in FIG. 6. FIG. 7, the vertical cross section of FIG. 5 taken through line 7—7, shows the holddown grips 36 with their threaded bolts 56 for clamping under the sill of a manhole frame or the like.

In the plan view of FIG. 8 the assembled base and peripheral flange are indicated generally by arrow 5. Pairs of lugs 18 and 18', projecting downwardly from the flange with their tops flush with cover seat 12, hold the flange from vertical parting from the base by fitting into the interfacing corresponding slots in the base below them. In the assembled condition, as shown in FIG. 8, it will be noted that the flange and the base are generally concentrically disposed relative to one another with the base being laterally inset relative to the keeper wall 14. In operation, the turning of the turnbuckle nut 62 in one direction draws the corresponding ends of the segments toward one another so as to cause the segments to move inwardly via a camming and sliding action between the corresponding slanted side surfaces of the corresponding lugs and slots, while actuation of the turnbuckle nut 31 in the opposite direction causes the segment ends to move away from one another. That causes the segments to move outwardly to press against the confining upper inner sidewalls of an existing manhole frame 78 (visible in FIG. 9). The assembly of FIG. 8 can be used with a nominally 22½–to 24-inch manhole frame, i.e. it fits a frame for a manhole of that nominal diameter. Once the base is tightly expanded and held down, set screws, not shown but slightly recessed in the holes 26 in the tops of the lugs, can be tightened to eliminate motion of the flange relative to the base.

Figure 9:
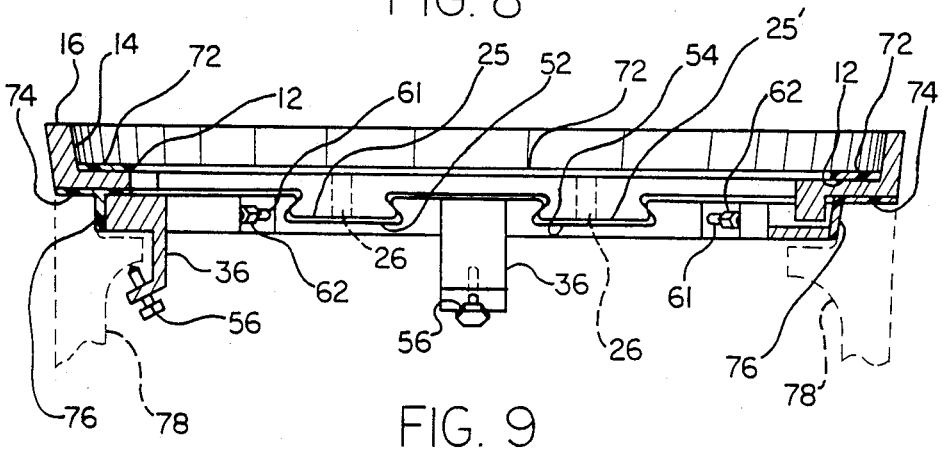
FIG. 9 is a cross sectional elevation of the sector of the assembled flange and base of FIG. 8 taken through lines 9—9, and it shows the sealer and retention component in place.

FIG. 9 shows the fit of the generally trapezoidal-in-cross-sectional-elevation lug bottoms 25 and 25' of the flange into the broadly similarly-shaped slots of the base with their flared bottoms 52 and 54. Also evident in this view is the frictional retention component 76 bonded to the outside wall of each of the base segments 2. The retention component 76 is about 0.1 inch thick. It is interposed between the outer periphery of the base and the confining inner wall of the old cover keeper of the existing manhole cover frame 78 (the vertical cross section of such frame being indicated in dotted lines). Expansion of the base presses this component 76, a slightly foamed elastomeric composition, tightly against inner wall of the old keeper of frame 78.

Resting on seat 12 and bonded thereto is a gasket 72 of like elastomer, about ⅛ inch thick, to seal against water leakage under the manhole cover and help silence it in use.

Under the seat 12 is a water seal 74, a ⅛-inch gasket of like elastomer bonded to the bottom of the peripheral flange. When installed in a street, the new manhole cover support thus can be virtually completely protected from the entry of surface water, providing that there are no holes in the fitted manhole cover itself. The holddown grips 36 are clamped into place under the old cover seat (sill) of the frame 72 by the use of bolts 56.

While the preferred embodiment of the new cover support has its lugs facing down from the flange and its slots facing up from the expandable base, it should be understood that other arrangements are operable, e.g. with the lugs and slots vice-versa, or with some pairs of lugs on one of these ring-like elements and some on the other, say, in alternating fashion, and so on.

A multiply-segmented base like the one shown in FIG. 5 has arcuate segments that, when assembled with the flange, can be essentially congruent with a surrounding circle if at all at only one setting of the spreader bolts 61. Therefore, it usually is practical to make that setting essentially midway of the effective outside diameter range of the bottom of the base ring, e.g. 23¼". The center lobe 32 generally will be longer than the two segment ends 46 and 42 together, as shown in FIG. 5, and this by about the width of the gap between the pairs of segment ends facing each other when the bolts 61 are adjusted to make all four segments fit within and just touch an essentially true circle when their outer peripheries are so joined.

There best should be some play between the corresponding lugs and slots when the flange and base are assembled together, i.e. between the surfaces 22 and 43, 24, and 33, 22' and 34, and 24' and 47. This is to facilitate the necessary but relatively limited expansion and contraction, in response to operation of the spreaders (bolts 61), of the base to an effective diameter about ¾ of an inch up or down from that of the true circle, or about 3–4%. A main feature of the interfacing and slidably engaging slots with the corresponding lugs is to preclude a complete vertical parting of the flange from the base. The base, of course, desirably can be anchored to the existing manhole cover frame, as by anchoring grips. If desired, similar anchoring grips, not shown, can be used to secure the peripheral flange to the base, to the sill of the existing support, or to both places. Such grips can extend downwardly from the lugs 18 and/or 18' (FIG. 1) of the flange 1.

Even a modestly expanded or contracted split base ring of sheet steel is unlikely to remain truly circular in outer periphery. Were its adjusted resulting shape to remain even closer to a true circle than that made by a multi-segmented base, and that is unlikely, any fixed lugs or slots of such split ring still would be subject to some misalignment. Accordingly, a fair amount of play between corresponding lugs and slots, facilitating a sliding fit over a small, say no more than about ±5% maximum effective diameter change but with preclusion of complete vertical separation one from the other, is desirable. If the thickness of the moving one of these two elements, e.g. the metal around the slots in the base 4, is no more than about ½ inch, this is less restrictive to the sliding range of base-flange engagement than are thicker walls around such slot. The lugs and/or the slot wall elements could be made centrally pivotable with their bottoms and tops in essentially horizontal planes to permit more sliding range between them, but this is an added expense.

Reference is now made to FIGS. 11–15 of the drawings.

Figure 10:
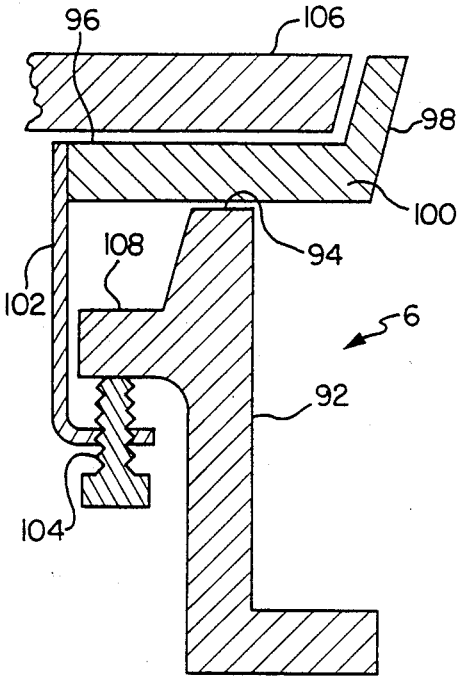
FIG. 10 is a fragmentary vertical cross section of another embodiment of the instant cover support taken through the flange and one of the plurality of its downwardly-reaching extensions. All of the extensions can be hooked directly under the sill (cover seat) of an existing manhole frame to anchor the support to such frame.

In FIG. 10, arrow 6 indicates generally the fragmentary cross sectional elevation of another embodiment of a round cover support, namely the section of the peripheral flange 100 taken directly through downward extension 102 therefrom, the extension hooking under the sill of manhole frame 92 by means of threaded bolt 104. The bottom of flange 100 rests on rim 94 of the keeper of frame 92. The extension 102 is a heavy steel strap, and it is attached to the flange 100 by means of screws not shown. The new manhole cover 106 rests on the seat 96 and is retained laterally by keeper 98. There are seven more extensions like 102 projecting downwardly from the inner periphery of the circular flange 100; these are not shown. The outside of and the bottom flange of the frame 92 are set in concrete, not shown. The bottom of extension 102 can, of course, be longer and have a plurality of threaded holes for accepting bolt 104 at different places along it.

Figure 11:
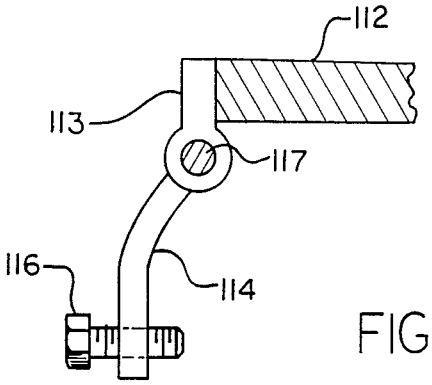
FIG. 11 is a fragmentary vertical cross section of a peripheral flange of a cover support from which a pivotable anchoring extension appends.

In place of the extension 102 of FIG. 10, one can use extensions like 114, pivoted from socket piece 113 that projects from the peripheral flange 112 in FIG. 11. Extension 114 is hookable under the sill of the existing manhole cover frame (not shown) by use of threaded bolt 116. Socket piece 113 is attached to flange 112. The extension 114 hinges from the socket piece 113 by pin 117, shown in vertical cross section like the fragment of flange 112.

Figure 12:
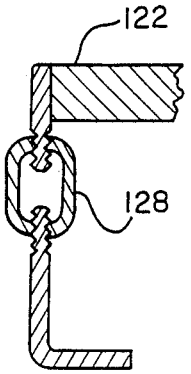
FIG. 12 is a fragmentary vertical cross section of a peripheral flange of a cover support having an alternative type of anchoring extension.

Also in place of extensions like 102 of FIG. 10 one can use in their places extensions like 128, projecting from the flange 122 in FIG. 12, hookable down under the sill of the frame (not shown) and tightenable thereto with its integral turnbuckle 128. Anchoring extensions for the peripheral flange and/or the base can be pivotally mounted, if desired, in many other ways for gripping. Usually they simply are affixed rigidly to the part or are made integral with it.

Figure 13:
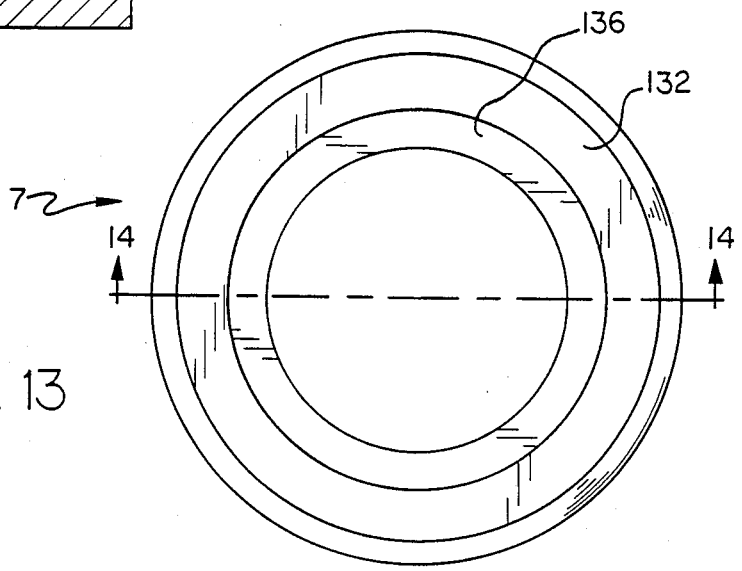
FIG. 13 is the bottom plan view of a cover support that also has a downwardly-reaching extension of the attaching-directly-under-the-sill-bottom type. This is a skirt-like element that reaches down as a mounting for a plurality of adjustable outwardly-reaching bolts to hook, grip or otherwise fasten under the sill.
Figure 14:
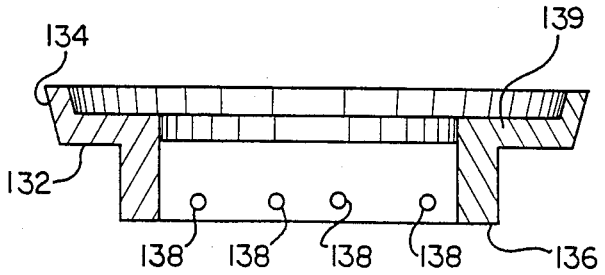
FIG. 14 is a vertical cross section of the cover support of FIG. 13 taken through center line 14—14.

Referring to FIGS. 13 and 14, arrow 7 indicates generally the cover support. In FIG. 13 one sees the keeper 134 of this cover support projecting away from the viewer from around the outer rim of the bottom 132 of the peripheral flange 139. Projecting toward the viewer is a skirt-like extension 136 of the peripheral flange 139. The extension is drilled and tapped near its bottom periphery to take eight threaded bolts whose long axes are substantially horizontal and generally radial to the vertical central axis of the cover support 7. In FIG. 14, four of the eight bolt holes 138 are seen. In this alternative type of cover support the downwardly-reaching extension from the flange is disposed for just fitting into the smallest existing frame or other existing receiving structure of the group whose grade is being raised.

The cover supports shown in FIGS. 10–15 can be rendered highly resistant to surface water infiltration around the outer wall of the cover support by means of a deformable water-blocking gasket under the seat, and the cover can be cushioned with a similar gasket on the seat; this improves the water blockage around the seat. Both such gaskets or polymer-containing deposits in lieu thereof can be bonded onto the cover support, if desired.

Figure 15:
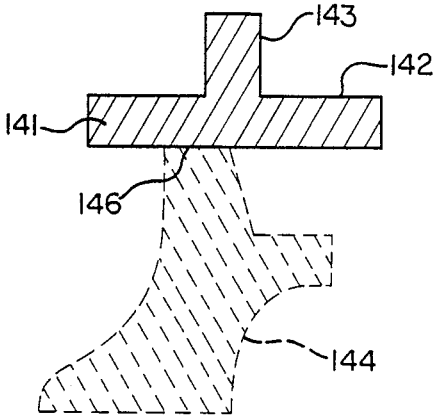
FIG. 15 is a fragmentary cross section of a peripheral flange of the cover support that has its cover keeper somewhat inboard of the outer periphery of the flange.

In FIG. 15 the peripheral flange 142 of a manhole cover support is shown resting on the top 146 (the rim) of a manhole cover frame 144. The cross section of the frame is indicated with dotted lines. Keeper 143 is inboard of the outer periphery of the flange 141; it rises from the outer periphery of the cover seat 142 and, with that seat, is effective to retain a manhole cover that is not shown.

While most manhole cover frames by far have keepers with a top rim that is fairly flat and without gaps, breaks or other apertures, it is of course possible to encounter existing manhole cover receiving structures that have them. The instant manhole cover support can be mounted on top of such rim usually quite well. If good water blockage is desired in such instance, one can resort to plugging up, caulking or stoppering such gaps, breaks or apertures with sealer material, usually polymeric and sometimes preformed into desired shapes. Similarly, if the keeper wall of the existing receiving structure has apertures, these must be treated likewise to eliminate possible leakage.

The top rim of the usual manhole cover frame is solid and often massive. However, some existing manhole cover receiving structures have fairly narrow rims. Such rims can be fitted with "widener" or "bearing" pieces before installing the new cover support if desired, e.g. longitudinally slotted, slit or split metal or composite tubing, typically a kind that presents a broadened flat top, as the new upper rim. Flexible metal- or fiber-reinforced polymer-containing materials, advantageously elastomeric, can be suitable for such service and for building up bad irregularities in an otherwise flat upper surface of the rim.

The keeper walls of the instant cover support can be quite thin, e.g. 12–16 gauge mild steel welded to the peripheral flange around its cover seat. It then is desirable to have a box member (hollow) or channelled wale or a solid one of greater width, e.g. ½" or wider, forming the top all around the keeper top for more strength and bearing surface.

Suitable frictional components and sealants for this service usually are flexible polymers, often elastomeric. Advantageously they can self-adhere or be adhered to most kinds of surfaces, e.g., with a cement, and advantageously also they can be expanded into a dense, closed cell foam.

Suitable polymers that can be formulated for use in the compressible retention component and the water seals herein include cork and cork-filled flexible sheeting, natural and synthetic rubbers, water-resistant ionomers, various vinyl polymers and copolymers such as polyvinyl acetate-polyethylene-acrylate copolymers and polyvinyl chloride homopolymers, plastisols such as a vinyl plastisol, polyurethanes, polyester resins, epoxy resins, styrene-containing copolymers such as ABS and butadiene-or isoprene-styrene copolymers, polyolefins and copolymers containing olefin units, and aminoplasts. Plasticizers, pigmentation, stains and/or fillers such as talc, carbon black, etc. commonly are employed in their recipes. The preferred retention components appear to be elastomeric, i.e., resilient. Many of them can be foamed and preferably are foamed only very slightly; this can soften them a bit without reducing their toughness too greatly and it can help to allow for some thermal expansion, and it makes them slightly less dense than without the foaming. Latent foaming agents reactive upon warming and/or catalyzing, incorporated in a film of an uncured polymer-providing material coated on a cover support are preferred. Curing with heat, ultraviolet or electron beam radiation and/or catalysis can be practiced.

Customarily, it is of advantage to prime the metal with a bonding agent or use a bonding treatment to secure the best bond of the retention component or a water sealing element to metal. Some polymers can bond well without this, e.g., epoxy resins. However, the bonds of most are improved by such priming and/or treating.

A preferred foamed plastisol formulation for the retention component is of Shore A Durometer hardness about 20–70, and preferably about 50–65, as are the water seals. The plastisol is compounded principally from low molecular weight polyvinyl chloride resin plasticized heavily with a conventional phthalate ester plasticizer. It contains minute percentages of stabilizer, red pigment and ozodicarbonamide blowing agent. Another preferred formulation of about the same Shore A Durometer hardness is a flexible polyolpolyurethane foam, slightly elastomeric and rubbery. Some polymer recipes need heat to cure and foam them, even with catalysis, and others cure and even foam at about room temperature (25° C.). The degree of foaming in both these plastisol and urethane formulations is very small, and it could be called almost microscopic and slight—the bubbles are closed-cell and tiny. In some cases, especially where sealing is to be maximized and strength considerations are secondary, a large degree of foaming and a resulting softened and less dense foamy structure can be tolerated, e.g., Shore A Durometer hardness of 20–55.

A recipe for a slightly-foamed polyurethane rubber that has been found to be quite effective here is as follows:

100 weight parts of Adiorene #L167 polyurethane, a product of the Uniroyal component of the B.F. Goodrich Company, Naugatuck, Conn.

Compounded with these additives:

0.3 weight part of water;

0.3 weight part of Dabco-33LV, a product of Air Products, Inc., Allentown, Pa.;

1.4 weight parts of DC-193, a product of Dow-Corning Inc., Midland, Mich.; and 16.0 weight parts of "BC", a product of Palmer, Sieka Inc., Port Washington, N.Y..

This material can be applied to warmed, cleansed and bonding agent-treated cast iron and steel, then heated to 121°–177° C. to develop the foam and full cure of the polymeric material.

Some preferred heat-curable plastisol retention component recipes for various Durometer hardness contain 100 parts of low molecular weight polyvinyl chloride resin plasticized with 60–70 parts of a conventional phthalate plasticizer such as dioctyl or dimethyl phthalate. With this 1–3 weight parts of a conventional stabilizer for polyvinyl chloride resin, e.g., a lead-based stabilizer, is used along with 1–2 weight parts of a red colorant (other pigments and colors, or none, can be used, if desired) and 0.5–3 weight parts of a conventional ozodicarbonamide heat-and water-activated blowing agent.

The preferred foamed plastisol usually is sprayed on the area to be coated. It is advantageous to spray it onto a hot metal cover support ring (188°–193° C.) and let it cure and foam a bit. If extra foaming and/or curing is desired, the coated part can be further warmed at 193°–204° C. for up to a few minutes.

The deformable retention component should be at least about a 0.1 mm. thick for most effective gripping to contact surfaces (which normally have irregularities). Preferably it should not be more than about 10–11 mm. thick for economy, general utility, and durability, although thicker retention components (or even portions of same) can be especially useful for sealing on some occasions. The same applies to cushioning components for cover seats, although these usually are at least about 1.2 mm. thick and easily can be as thick as 12 mm. or even more.

Metal surfaces should be cleaned to accept the polymeric material if it is to be bonded thereto. Then a customary bonding agent such as Chemlok #218 (Manufactured by Lord Corporation, Erie, Pa.) is applied, dried and warmed. Various other useful bonding agents are available such as a Pliobond type (made by the Goodyear Tire and Rubber Company).

As shown above, the preferred materials of construction for most of the cover support, i.e., the flange, extensions thereof and bases and various elements such as screws, are of a ferrous metal, e.g., steel such as rod, bar or sheet, and/or cast iron, particularly cast ductile iron for the rings. Other metals can be used where their special properties are desirable and their cost can be tolerated, e.g., stainless steel, high tensile strength steel, wrought iron, bronze, brass, etc. Also, suitable in some cases for various cover support parts, e.g. for much of the flange and base structures, are structures made from glass fiber-, aramid fiber-, or graphite fiber-reenforced resin, e.g., a thermosetting (curable) resin such as a polyester, polyamide or epoxy resins. Also highly filled polymers including elastomers, or ABS plastic and the like, i.e., tough structural polymeric materials can be used in the invention. In some instances, it is possible to fit a metal shape, e.g., a frame or armature such as a fixed diameter or an expansible steel hoop, to the inside part of a ring-like manhole cover support element. Such elements can then otherwise be almost entirely a tough, flexible polymeric, e.g. rubber-like material, optionally pigmented (filled) with, e.g., carbon black. Also, they may optionally be built up in plies with glass, nylon, cotton and/or steel cloth, wire and/or cords (like a truck tire carcass). In such instances, the outer part of the base can act as the retention component, although softer, elastomeric, polymer-containing coatings or films often can be used with advantage as special retention components laid over or bonded onto a harder polymer-containing substrate.

While an expandable base has been shown with four segments, it clearly can have more or less segments, or can even be a split ring with a single spreadable joint. In tests on broadly related manhole cover supports for use with a nominally 23-inch manhole, a split steel ring cover support had roughly double the grip in a steel retaining ring when coated with a heat-cured vinyl plastisol retention component as when uncoated to give steel-to-steel contact. Furthermore, the force needed to remove a broadly related four-segmented cover support of the same size from the same retaining ring was about 1.41 times that for the split ring one when both had the same kind of vinyl plastisol retention component on their outer walls and about the same retaining stress was exerted thereon.

The preferred type of turnbuckle spreader for the base is shown in the drawings. Of course, the more conventional turnbuckle with a central female member receiving a threaded bolt from each side, the bolts being threaded oppositely to each other, can be used. Also useful is simply a threaded bolt working against an inwardly-projecting bracket-like reaction piece as the spreader device, the bolt being threaded through an inwardly projecting opposing bracket and pressing the reaction piece away therefrom, thus enlarging the outer periphery of the base. While the peripheral flange has been illustrated as a one-piece unit, clearly it can be made of a plurality of joined sections, e.g. bolted together, if desired.

Modifications and variations of the invention will be apparent to those skilled in the art in the light of the foregoing detailed disclosure. Therefore, it is to be understood that, within the scope of the appended claims, the invention can be practiced otherwise than shown and described.

What is claimed is:

1. A manhole cover support for raising the effective grade of an existing manhole cover-receiving structure having an upwardly projecting keeper with a rim at its top, said existing cover-receiving structure being for one of a group of existing manhole cover-receiving structures whose existing cover openings are geometrically similar but include ones that differ in the area, the cover support comprising:

a peripheral flange that at least substantially completely covers and rests on said rim, the outer periphery of said flange being at least about coextensive with that of the largest rim of said group, the flange including a bottom for resting on said rim, a seat thereabove for a cover, and a cover keeper that rises from the outer periphery of said seat, the seat being one that accommodates a manhole cover standardized for the entire group; and means for anchoring the peripheral flange to a fixed part of the existing manhole structure.

2. The cover support of claim 1 wherein the flange accommodates a circular manhole cover.

3. The cover support of claim 1 wherein the means for anchoring includes an expandable base beneath the flange, the base having at least one adjustable joint equipped with a spreader device capable of making the base fit tightly within the confines of the keeper of the existing manhole cover-receiving structure, and the flange and base are in an engagement which precludes their substantially parting vertically from each other.

4. The cover support of claim 3 wherein the base and the inner periphery of the flange are round, and the flange and base are connected by interfacing lugs and corresponding slots that are in essentially horizontal slidable engagement with respect to each other, a lug having a shoulder that is restrained by a surface of its corresponding slot from disengagement in a vertical direction from the corresponding slot.

5. The cover support of claim 1 wherein the means for anchoring includes a plurality of downwardly-reaching extensions from the flange, the extensions being fastenable under the sill of the existing manhole cover receiving structure and/or to a base confined in the keeper of the existing manhole cover-receiving structure.

6. The cover support of claim 5 wherein the extensions are fitted with screw means near their bottoms.

7. The cover support of claim 5 wherein the extensions are adjustable in length, and the bottom of the seat is equipped with a deformable seal.

8. A manhole cover support for raising the effective grade of an existing manhole cover-receiving structure for a round manhole cover, the receiving structure having a keeper with an inner wall and a top rim, the support comprising:

an expandable base ring that can be adjusted to make a snug fit within the inner wall of the existing receiving structure and not project thereabove, the base ring having at least one adjustable joint equipped with a spreader device; and a peripheral flange that substantially completely covers said rim, said flange including a cover seat, a cover keeper rising from the outer periphery of the seat, and a bottom that can rest on the top of the existing manhole cover-receiving structure, the base and flange being equipped with interfacing lugs and corresponding slots in a slidable engagement with each other that restrains the base and flange from a substantial vertical parting.

9. The manhole cover support of claim 8 wherein the base ring has the slots, and the top ring the lugs.

10. The manhole cover support of claim 9 wherein a lug bottom and its slot have complementing base-down trapezoidal cross-section elevations.

11. The manhole cover support of claim 9 wherein there are anchoring extensions extending downwardly from the base ring for securing it to a fixed part of the existing manhole structure.

12. The manhole cover support of claim 9 wherein the base ring is divided into a plurality of segments with an adjustable joint between the opposing ends of each segment.

13. The manhole cover support of claim 11 wherein the spreader devices are turnbuckles across the joint.

14. The manhole cover of claim 11 wherein the base ring comprises a cast iron.

15. The manhole cover support of claim 8 wherein there is a frictional retention component around at least part of the outside of the base ring.

16. The manhole cover support of claim 15 wherein a retention component is bonded to the outside of the base ring.

17. The manhole cover support of claim 16 wherein the retention component is foamed and comprises flexible polymer.

18. The manhole cover support of claim 16 wherein the retention component comprises elastomer.

19. The manhole cover support of claim 8 wherein there is a deformable water seal interposed between the bottom of the flange and the top of the existing manhole cover receiving structure.

20. The manhole cover support of claim 19 wherein the seal is bonded to the flange.

21. The manhole cover support of claim 20 wherein the seal is foamed and comprises flexible polymer.

22. The manhole cover support of claim 20 wherein the seal comprises an elastomer.

23. A manhole cover support for raising the effective grade of an existing manhole cover-receiving structure having an upwardly projecting keeper with an inner wall and a top rim, said cover support accommodating a round manhole cover of a diameter that is the same as or different from the diameter of the cover which can be accommodated by the existing manhole cover-receiving structure, the support comprising:

an expandable base ring with an outer wall, said base ring consisting essentially of ferrous metal, the base ring being adjustable to make a snug fit within the inner wall of the existing receiving structure and not project thereabove and having at least one adjustable joint equipped with a spreader between the opposing ends of each segment, and the base ring being equipped with a set of open-topped slots; and there being extensions that extend from the base ring for anchoring it to the existing manhole cover-receiving structure and a frictional retention member bonded to the outer wall of the base ring, a peripheral flange providing the raise in grade, the flange consisting essentially of ferrous metal and having an outer periphery at least as large as that of the rim, the flange including a cover seat, a cover keeper rising from the seat, and a bottom for resting on said rim, the flange being equipped with a set of downwardly-facing lugs that are in slidable engagement with the set of slots of the base ring;

the engagement restraining the base ring and flange from substantial vertical parting from each other.

24. The manhole cover support of claim 23 wherein the flange and base ring are made of cast ductile iron, and there are separating lifts between them.

25. The manhole cover support of claim 23 wherein there is a water seal bonded to the bottom of the top ring for resting on the top of the existing manhole cover receiving structure, and the seal and the retention component comprise flexible foamed polymer.

26. The manhole cover support for raising the effective grade of an existing manhole cover-receiving structure having a keeper with an inner wall and a top rim and accommodating a manhole cover of a standardized diameter that is larger in diameter that the cover which can be accommodated by the existing manhole cover-receiving structure, the support comprising:

an expandable, multi-segmented base ring comprising cast ductile iron, the base ring being adjustable to make a snug fit within the inner wall of the existing receiving structure and not project thereabove and having an adjustable joint equipped with a turnbuckle spreader between the opposing ends of each base ring segment; and a peripheral flange comprising cast ductile iron, the flange providing a new cover seat which extends beyond the outer periphery of the base ring, the flange having a cover keeper rising from the outer periphery the seat and being able to rest on the top rim of the existing manhole receiving structure, the base ring being equipped with a set of open-topped, downwardly-facing dovetail slots;

the flange being equipped with a set of downwardly-facing dovetail-bottomed lugs in slidable engagement with the set of slots of the base ring, the resulting engagement restraining the flange and base rings from substantial vertical parting from each other, there being a plurality of anchoring grips to the existing manhole cover-receiving structure extending from the base ring, separating lifts between the base ring and the flange, a water seal bonded to the bottom of the flange for resting on the top rim of the existing receiving structure, and a frictional retention component bonded to the outer periphery of the base ring, both the retention component and the seal comprising elastomeric foamed polymer.

27. The manhole cover support of claim 26 wherein the base ring includes an adjustable joint between the opposing ends of each segment.

* * * * *